United States Patent [19]

Fujiwara et al.

[11] Patent Number: 4,604,164

[45] Date of Patent: Aug. 5, 1986

[54] FLOW RESTRAINING ELEMENTS IN THE HEADBOX OF A PAPER MACHINE

[75] Inventors: Haruyoshi Fujiwara; Tetsuo Makino, both of Mihara, Japan

[73] Assignee: Mitsubishi Jukogyo Kabushiki Kaisha, Tokyo, Japan

[21] Appl. No.: 696,431

[22] Filed: Jan. 30, 1985

[51] Int. Cl.[4] ..... D21F 1/02

[52] U.S. Cl. ..... 162/343; 162/344

[58] Field of Search ..... 162/343, 344–347, 162/336

[56] References Cited

U.S. PATENT DOCUMENTS

| | | | |
|---|---|---|---|
| Re. 28,269 | 12/1974 | Hill et al. | 162/343 |
| 4,133,715 | 1/1979 | Hergert | 162/343 |
| 4,181,568 | 1/1980 | Pfaler | 162/343 |
| 4,504,360 | 3/1985 | Fujiwara | 162/344 |

FOREIGN PATENT DOCUMENTS

| | | | |
|---|---|---|---|
| 71118 | 2/1983 | European Pat. Off. | 162/343 |
| 2019465 | 10/1979 | United Kingdom | 162/343 |

*Primary Examiner*—S. Leon Bashore
*Assistant Examiner*—K. M. Hastings
*Attorney, Agent, or Firm*—Wenderoth, Lind & Ponack

[57] ABSTRACT

A headbox for a paper machine comprising a top plate and a bottom plate defining a chamber therebetween and a plurality of flow restraining elements disposed one above another in the chamber to define a plurality of paths spaced one above another therein. The top and bottom plates are connected to one end to a perforated plate defining an inlet for the chamber and approach each other as they approach an outlet for the chamber. Each element is removably connected at one end to the perforated plate, and the paths extend from the inlet to the outlet. Each element has a mildly corrugated upper surface and a mildly corrugated lower surface which approach each other until they terminate in a free end remote from the perforated plate. Those surfaces are substantially symmetrical to each other with respect to a center line of said element. Each element has a free end portion formed from an easily deformable material, such as rubber or plastics. The surfaces of each element define an angle of 1° to 15° therebetween.

8 Claims, 2 Drawing Figures

FLOW RESTRAINING ELEMENTS IN THE HEADBOX OF A PAPER MACHINE

BACKGROUND OF THE INVENTION

1. Field of the Invention

This invention relates to a headbox in a paper making machine. More particularly, it relates to flow restraining elements in the headbox.

2. Description of the Prior Art

A conventional headbox for a paper making machine which is described in one of the applicants' copending U.S. application Ser. No. 662,817, filed Oct. 22, 1984, which is a continuation of application Ser. No. 484,694, filed Apr. 19, 1984, now abandoned, is shown by way of example in FIG. 1. It comprises a top plate 2 and a bottom plate 3 defining therebetween a chamber in which a plurality of flow restraining elements 1 are provided one above another. Each element 1 is held at one end by one of a plurality of grooves formed in a perforated plate 4 disposed upstream of the elements 1. The flow of a raw paper liquid in the chamber maintains the elements 1 in their positions shown in FIG. 1. The elements 1 define a plurality of paths 5. Those portions of the paper material which flow through the paths 5 meet downstream of the elements 1, and ran paper liquid is ejected onto a wire not shown after its degree of opening has been controlled by a slice lip 6.

A plurality of paths defined by a plurality of flow restraining elements enable the effective dispersion of fibers in the liquid with a small head loss and thereby the production of paper of high quality.

The known flow restraining elements as shown at 1 in FIG. 1, however, have a number of drawbacks. They are difficult to make because of their large variation in thickness defining narrow neck portions at the positions of narrowest thickness. They easily get warped along their width. Correctly sized paths are, therefore, difficult to define. The elements break easily at any portion of reduced thickness (neck portion). Those portions of the elements at which they are connected to the perforated plate are so small in thickness that they easily get deformed and are difficult to attach to, or detach from, the perforated plate.

SUMMARY OF THE INVENTION

It is an object of this invention to provide an improved headbox for a paper making machine including improved flow restraining elements which are easy to make and which define correctly sized paths.

This invention provides an improvement in a paper machine headbox comprising a top plate and a bottom plate connected at one end to a perforated plate, defining a chamber therebetween. The top plate and bottom plate approach each other toward a slice lip, and a plurality of flow restraining elements are disposed in the chamber to define a plurality of paths therein. Each flow restrainig element is removably connected at one end thereof to the perforated plate, through which a liquid paper material is introduced into the paths.

According to a salient feature of this invention, each flow restraining element has a thickness which gradually decreases as it becomes farther from the perforated plate. This gradually decreasing thickness is defined by an upper surface and a lower surface which approach each other until they join each other at the free end of the element. The upper and lower surfaces have a substantially equal mildly corrugated pattern and the corrugations on each surface extend in a downstream direction so that the successive portions of the corrugations of least thickness also become thin gradually in the downstream direction. At least that portion of each element which terminates in its free end is formed from an easily deformable material, such as rubber or plastics, so that that portion may be easily deformable along the width of the element.

The upper and lower surfaces of each element preferably define an angle of 1° to 15° therebetween.

Each element has a gradually decreasing thickness and its upper and lower surfaces are mildly corrugated. In other words, its thickness varies only to a small extent. Its upper and lower surfaces are substantially symmetrical to each other with respect to a center line of said element. Therefore, the elements are not appreciably warped when they are made. They are not appreciably warped despite variation in temperature during the operation of the paper machine.

Insofar as they are not easily warped, they are easy to make and they ensure that correctly sized paths be maintained. That portion of each element which terminates in its free end is formed from an easily deformable material, such as rubber or plastics, and has a very small thickness. Therefore, the warpage of the element, if any, is easily rectified by its deformation when the liquid paper material is caused to flow through the paths. This feature contributes to ensuring the correct dimensions of the paths.

The elements have a gradually decreasing thickness and its surfaces are mildly corrugated and do not define any portion that is extremely thick or thin. Therefore, they are not easily broken, yet they are light in weight and easy to handle. That end of each element at which it is connected to the perforated plate has a sufficiently large thickness so that the end is not easily bent, and is, therefore, easy to connect to, or disconnect from, the perforated plate.

Other features and advantages of this invention will become apparent from the following description and the accompanying drawings.

DETAILED DESCRIPTION OF THE INVENTION

Figure 1:
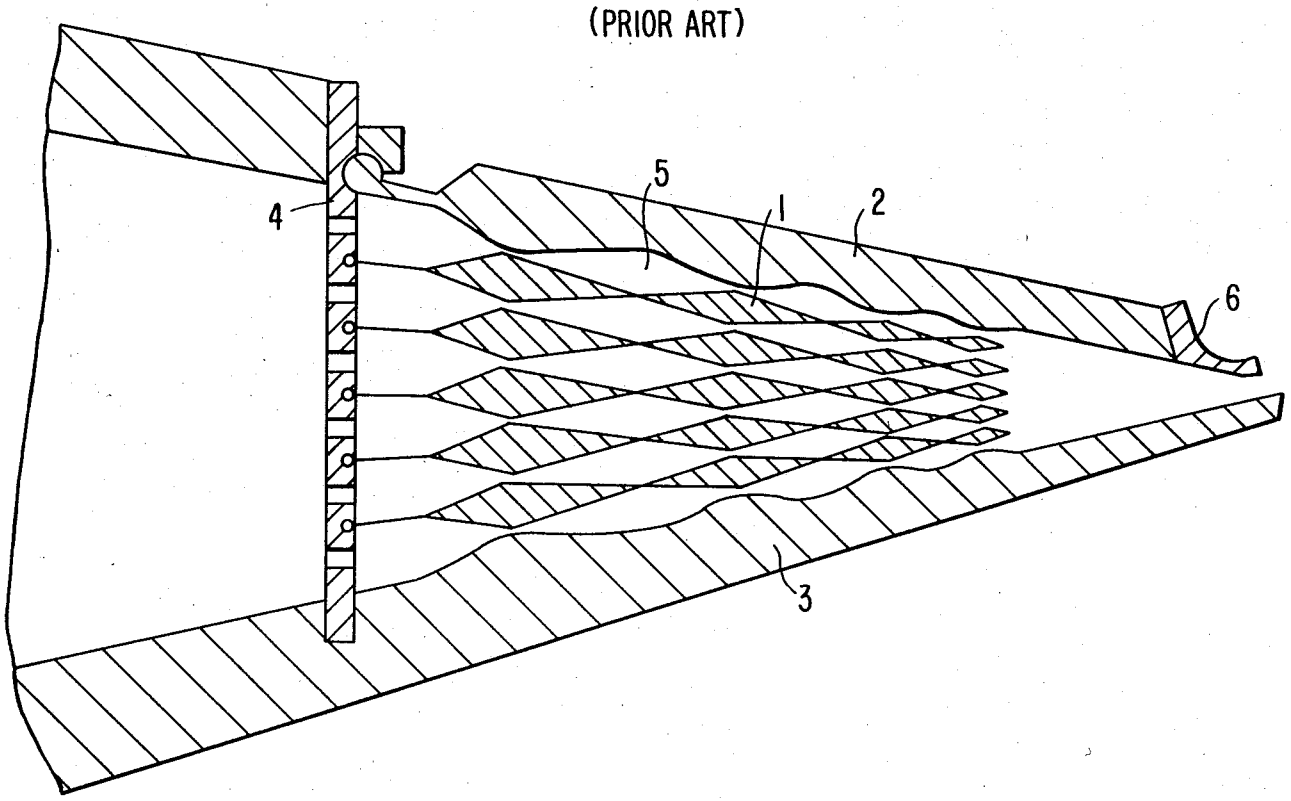
FIG. 1. (PRIOR ART)
FIG. 1 is a longitudinal and vertical sectional view of a paper machine headbox known in the art.
Figure 2:
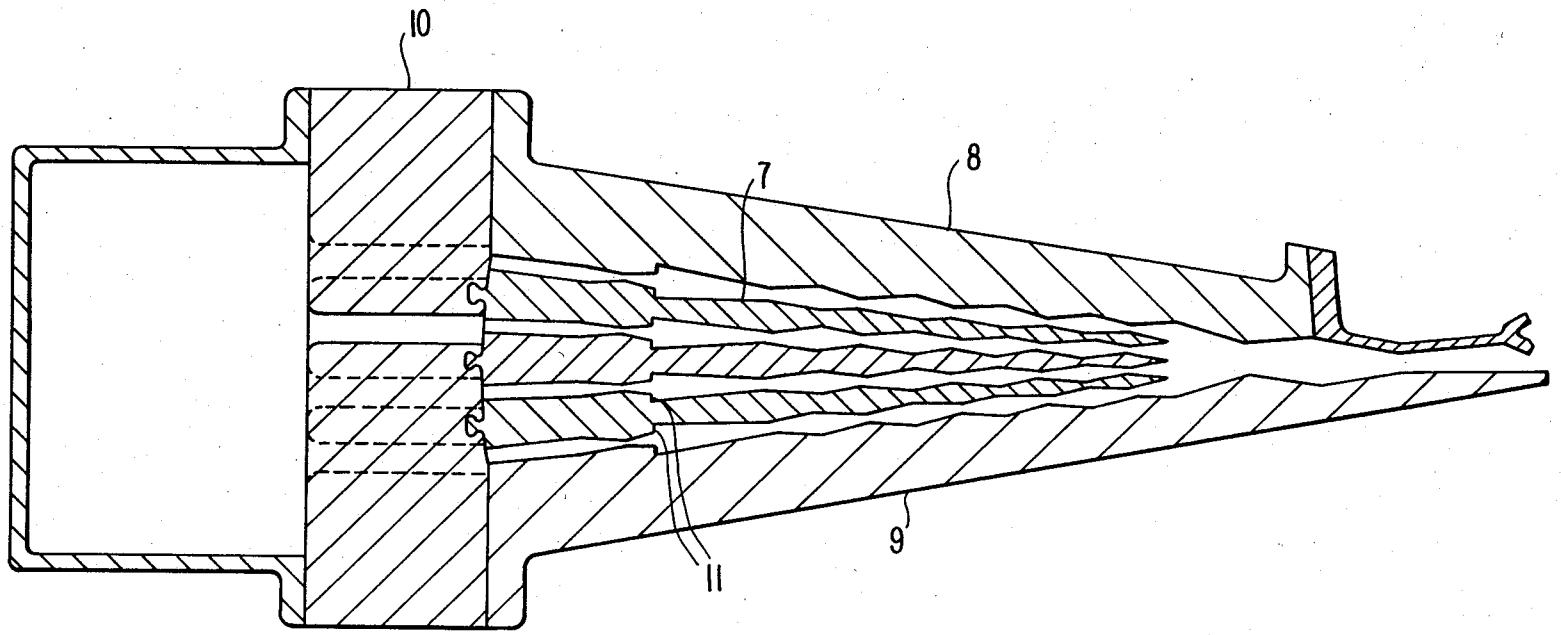
FIG. 2 is a longitudinal and vertical sectional view of a headbox embodying this invention.

A headbox embodying this invention is shown by way of example in FIG. 2. It comprises a plurality of flow restraining elements 7 disposed one above another in a chamber defined between a top plate 8 and a bottom plate 9. Each element 7 is connected at one end to a surface, which is convex in shape towards elements 7, of a perforated plate 10, defining an inlet for the chamber.

Each element 7 has a mildly corrugated upper surface and a substantially equally mildly corrugated lower surface. The upper and lower surfaces approach each other gradually until they terminate in a free end located remotely from the perforated plate 10 and in the vicinity of an outlet for the chamber. The surfaces preferably define an angle of 1° to 15° therebetween. If this angle is smaller than 1°, it is difficult to form each element 7 and particularly its free end portion with satisfactorily corrugated surfaces which create a satisfactory stirring effect on the liquid which is caused to flow through the paths defined by the elements 7. If the angle is larger than 15°, that end of each element 7 at which it is connected to the perforated plate 10 is too large in thickness and makes the element heavy and difficult to handle. The upper and lower surfaces of each element 7 shown in FIG. 2 have an angle of about 4° therebetween by way of example.

The corrugated surfaces are defined by corrugations which extend in a downstream direction. The corrugated surfaces serve to create a turbulent flow in the liquid. They define paths having a cross sectional configuration which gradually increases or decreases along the elements 7 and thereby causes the liquid to flow at a speed which decreases and increases along the paths. The dimensions of the corrugations are so selected as to ensure that the cross sectional thickness of each element 7 varies mildly. For example, the upstream portions of decreased cross-sectional thickness have greater cross-sectional thickness than the downstream portions of increased cross-sectional thickness. The corrugated upper and lower surfaces are substantially symmetrical to each other with respect to a longitudinal axis of said element.

The free end portion of each element 7, which has a very small thickness, is formed from a material having a low modulus of elasticity and a specific gravity of about 1, such as rubber or plastics, so that it may be easily deformable. The other portion may be formed from the same material, or any other material.

With reference to FIG. 2, it can be seen that each element 7 has a recessed portion defined by a wall 11 on the upper and lower surfaces of each element. These walls 11 are perpendicular to the longitudinal axis of each element 7 and form an abruptly enlarged area in each flow path which creates an additional stirring effect on the liquid flowing through the chamber. The upper and lower surfaces of the element 7 diverge from each other in the downstream direction from the walls 11.

What is claimed is:

1. In a headbox for a paper making machine, the headbox having a iop plate and a bottom plate defining a chamber therebetween, a perforated plate connected to an inlet end of said top plate and an inlet end of said bottom plate to form an inlet of said chamber, said top plate and said bottom plate approaching each other at an outlet end spaced from said inlet end to form an outlet of said chamber, and a plurality of flow restraining elements disposed one above another in said chamber to define a plurality of flow paths spaced one above another in said chamber, said flow restraining elements extending from said inlet to said outelt, having free ends at said outlet, and being removably connected at one end thereof to said perforated plate, the improvement wherein;

each of said flow restraining elements has an upper surface and a lower surface which approach each other until they meet at said free end in a downstream direction away from said perforated plate toward said outlet end, said upper and lower surfaces each having a surface portion having corrugated patterns which are symmetrical with respect to each other and formed by a cross section perpendicular to said downstream direction, which alternately gradually increases and decreases along the length of said flow restraining elements to said free end so as to define alternating portions of increased and reduced cross section, such that the increased cross sections gradually decrease in said downstream direction and the decreased cross sections gradually decrease in said downstream direction, said cross sections varying sufficiently gradually between successive portions of increased and reduced cross section so as to resist warping during variable temperature use, said upper surface and said lower surface defining an angle of 1° to 15° therebetween, said free ends of said flow restraining elements being formed from a flexible material selected from the group of flexible material consisting of rubber and plastic, said material having a low modulus of elasticity and a specific gravity of about 1.0 so as to be easily deformable, each of said flow restraining elements being provided with an upper recessed protion on said upper surface and a lower recessed portion on said lower surface, said upper and lower recessed portions being respectively defined by an upper wall on said upper surface and a lower wall on said lower surface which are substantially perpendicular to said downstream direction, said flow restraining element being arranged in said chamber with said recessed portions adjacent one another to create an abruptly enlarged area in each of said paths between adjacent flow restraining elements, said recessed portions being located between said perforated plate and said surface portions of said flow restraining elements having said corrugated patterns, and said flow restraining elements being positioned in said chamber with said corrugated patterns symmetrical with respect to each other, whereby the flow paths between adjacent flow restraining elements have cross-sectional configurations which gradually increase and gradually decrease, thus causing liquid which flows between said flow restraining elements in said downstream direction to have a speed which decreases and increase to create a stirring effect on the liquid.

2. The improved headbox of claim 1, wherein each of said flow restraining elements consist entirely of plastic.

3. The improved headbox of claim 1, wherein said angle between said upper surface and said lower surface is 4°.

4. The improved headbox of claim 1, wherein said perforated plate has a surface forming an inside wall of said chamber, said surface of said perforated plate being convex in shape towards said flow restraining elements.

5. The improved headbox of claim 1, wherein the most upstream one of said reduced cross section portions has a cross section greater than that of the most downstream one of said increased cross section portions.

6. The improved headbox of claim 1, wherein said upper and lower surfaces diverge from each other in a downstream direction respectively from said upper and lower walls.

7. The improved headbox of claim 1, wherein said upper and lower walls are spaced from said perforated plate at locations downstream of said perforated plate.

8. The improved headbox as in claim 1, wherein said top plate has a corrugated inner surface which is substantially symmetrical to said upper surface of the uppermost element, while said bottom plate has a corrugated inner surface which is substantially symmetrical to said lower surface of the lowermost element with respect to a substantially horizontal plane.

* * * * *